United States Patent [19]

Olivieri

[11] Patent Number: 4,467,538

[45] Date of Patent: Aug. 28, 1984

[54] SKI BOOT WITH LOCKING LEVER DEVICE

[75] Inventor: Icaro Olivieri, Treviso, Italy

[73] Assignee: Icaro Oliveri & C. Minuterie Metalliche S.p.A., Treviso, Italy

[21] Appl. No.: 358,245

[22] Filed: Mar. 15, 1982

[30] Foreign Application Priority Data

Mar. 16, 1981 [IT] Italy ..... 61925/81[U]

[51] Int. Cl.[3] ..... A43B 5/04

[52] U.S. Cl. ..... 36/121

[58] Field of Search ..... 36/117, 120, 121, 50

[56] References Cited

U.S. PATENT DOCUMENTS 3,793,747 2/1974 Mochizuki ..... 36/121

4,190,970 3/1980 Annovi ..... 36/117

4,282,659 11/1981 Bourque et al. ..... 36/121

FOREIGN PATENT DOCUMENTS 1,068,106 12/1979 Canada ..... 36/121

*Primary Examiner*—Patrick D. Lawson

*Attorney, Agent, or Firm*—Paul D. Weaver

[57] ABSTRACT

A ski boot and lever locking device includes a plastics boot body having a front opening defining an adjustable closure and an encircling element on the portion of the boot body affected by adjustment of the front opening and provided with traction elements toward the rear of the boot body.

12 Claims, 2 Drawing Figures

SKI BOOT WITH LOCKING LEVER DEVICE

BACKGROUND OF THE INVENTION

The present invention relates to a ski boot and locking lever device.

Many ski boots with locking devices are known having a locking lever solidly connected to one edge of the upper and coacting with a ring fixed to the opposing edge of the upper and being engageable by a tooth of the lever.

Also known are boots with locking devices consisting of a lever attached to one edge of the boot upper and provided with a ring engageable with a projection or another locking element on the opposing edge of the upper.

A common feature of the above prior art devices is that the locking lever is placed on the forward part of the boot and exerts direct traction on the coacting locking element forming the element of linkage between the two edges of the upper to draw the two edges together for closing and locking the boot.

The above arrangement has the drawback in that the traction or closing action exerted by the locking lever on the ring or other element is in a limited zone of the upper, thus bringing about an uneven distribution of stresses, contrary to requirements for good ski boots.

Furthermore, in the known ski boots, the forward positioning of the locking lever or levers offers the possibility that the lever could be engaged by slalom poles or other obstacles present along the course of a downhill race. Also, the forward lever can injure the skier or others in case of falls or collision.

Accordingly, the present invention eliminates all of these drawbacks through the provision of a ski boot having a lever locking device, comprising a plastics boot body having a front opening defined by opposing side edges characterized in that it comprises a loop element encircling the boot body in a region affected by the front opening and provided with traction means toward the rear of said body. Advantageously, the loop element can consist of a substantially truncated conical loop having rearward divergence.

The traction means can consist of a strap connected with the encircling loop and a locking lever connected to the rear of the boot body and engaging the strap adjustably.

Other features and advantages of the invention will become apparent during the course of the following description.

DETAILED DESCRIPTION

Figure 2:
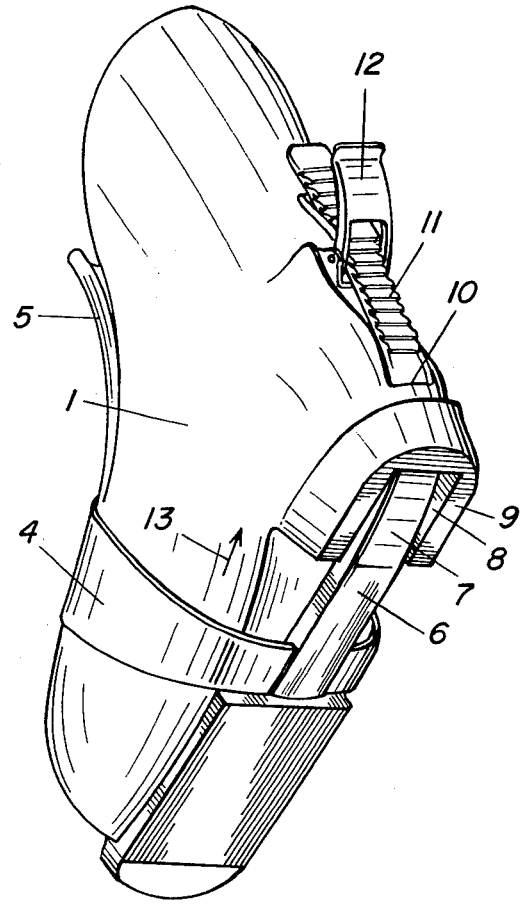
FIG. 2 is a rear perspective view of the boot from below.
Figure 1:
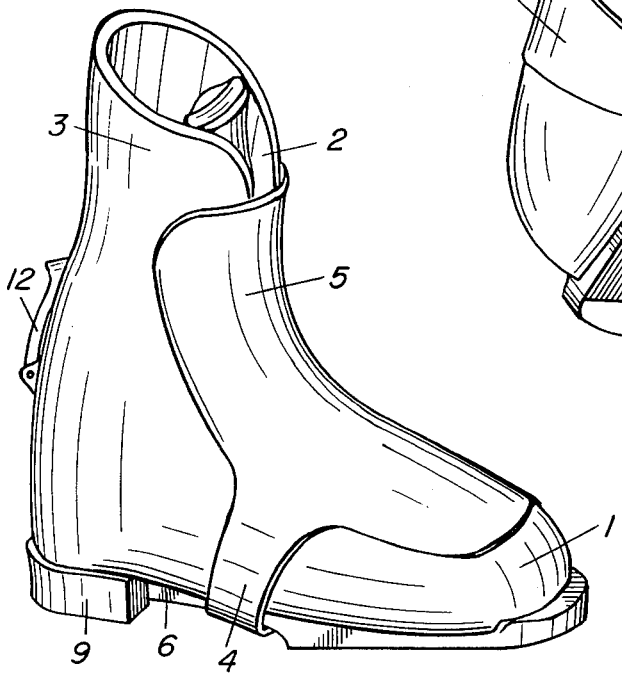
FIG. 1 is a perspective view of a ski boot and lever locking device according to the invention.

Referring to the drawings in detail wherein like numerals designate like parts, a boot according to the invention is formed of plastics material by injection molding techniques. The boot thus formed comprises a body 1 having a front opening 2 bounded by opposing edges 3 which are spaced apart when the boot is unlocked and are drawn together by locking or closing. It is also possible for the two edges of the front opening to be overlapped and superimposed by the locking operation.

The foot portion of boot body 1 is encircled by a loop 4 having essentially a truncated cone shape and conforming to the shape of the adjacent part of the boot body. The loop element 4 is stretched forwardly and rearwardly to completely cover the front opening 2 and to form the tongue 5. Below loop element 4, the same is connected through a longitudinal block 6 with a strap 7 positioned in a seat 8 of the boot heel 9 complementary to the block 6. After having passed through a slot 10 in the heel, a toothed extension 11 of the strap 7 engages with a traditional locking lever 12 fixed to the rear of the boot body.

In the illustrated embodiment, loop element 4, tongue 5, longitudinal block 6 and strap 7 are formed as a unit from plastics by injection molding. These elements could be made separately from plastics or from different materials, such as metal, and could then be connected one to another in a known manner.

The locking lever 12 at the rear of the boot is somewhat above the heel.

Boot locking takes place in the following manner. Whenever the loop element 4 is in an advanced position and the strap 7, while being engaged by the locking lever 12, is not placed under tension, the edges 3 of opening 2 can be spaced to allow easy introduction of a skier's foot into the boot.

To lock the boot, the lever 12 is actuated and this exerts tension on the strap 7 which tension is transmitted through the block 6 to encircling loop element 4 which is drawn rearwardly on the boot in the direction of the arrow 13 in FIG. 2.

As the element 4 is drawn rearwardly and guided by coaction of the block 6 in the heel seat 8, owing to its inextensibility, it causes gradual and progressive closing of the front opening 2 in the desired degree, thus locking the boot onto the skier's foot. To reopen the boot, it is only necessary to release the lever 12 and allow the forces present in the system to return the loop 4 forwardly on the boot with a consequent opening of the boot and loosening thereof.

As stated above, the boot according to the invention has several advantages and, in particular, it provides through a rear locking lever arrangement an efficient locking effect transmitted evenly on the entire boot closure across the arch of body 1.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A ski boot and lever locking device comprising a boot body having a front opening including opposing edges, an encircling element on the boot body adjacent to the front opening and having traction means extending near the rear of said body, a coacting locking lever for said traction means on the rear of the boot body, said traction means comprising a strap connected with the encircling element adjacent to the sole of the boot, said locking lever being engageable with said strap at the rear of the boot above the level of the boot heel, and a longitudinal substantially rigid guide element connected between said encircling element and said strap, there being a guide passage for the guide element in the heel portion of the boot and there also being a guide slot for said strap near the rear of the boot.

2. A ski boot and lever locking device as defined in claim 1, and the strap having adjusting teeth to engage said lever.

3. A ski boot and lever locking device as defined in claim 1, and said encircling element, guide element and strap being integrally formed as a unit.

4. A ski boot and lever locking device comprising a boot body having a front opening including opposing edges and means causing the side contraction of the body and the reciprocal approach of the edges, said means comprising a ring element encircling the boot body adjacent to the front opening and having traction means extending near the rear of the boot body and operable to cause horizontal rearward displacement of the ring element on the boot body during the operation of locking the boot.

5. A ski boot and lever locking device as defined in claim 4, wherein the ring element is substantially inelastic and defines roughly a truncated cone loop having rearward divergence at an angle substantially corresponding to the tapering of the boot body in the vicinity of the ring element.

6. A ski boot and lever locking device as defined in claim 4, and an elongated tongue element attached to the upper side of the ring element and extending forwardly and rearwardly thereof in covering relationship to said front opening and being disposed on the exterior of the boot body.

7. A ski boot and lever locking device as defined in claim 4, and said traction means comprising a strap connected with the ring element adjacent to the sole of the boot, and said lever being engageable with the strap at the rear of the boot above the level of the boot heel.

8. A ski boot and lever locking device as defined in claim 7, and a longitudinal substantially rigid guide element connected between the ring element and said strap, there being a guide passage for the guide element in the heel portion of the boot body and there also being a guide slot for the strap near the rear of the boot.

9. A ski boot and lever locking device as defined in claim 8, and the strap having adjusting teeth thereon to engage the locking lever.

10. A ski boot and lever locking device as defined in claim 4, and the boot body being formed of plastics material.

11. A ski boot and lever locking device as defined in claim 4, and said traction means extending longitudinally of the boot from the ring element rearwardly toward the boot heel and emerging at the rear of the boot adjacent to the locking lever.

12. A ski boot and lever locking device as defined in claim 8, and the ring element, guide element and strap being integrally connected as a unit.

* * * * *